United States Patent [19]

Doyel

[11] Patent Number: 4,536,977

[45] Date of Patent: Aug. 27, 1985

[54] PORTABLE, HAND-HELD STEAMING OR PRESSING DEVICE

[76] Inventor: John S. Doyel, 404 W. 20th St., New York, N.Y. 10011

[21] Appl. No.: 591,971

[22] Filed: Mar. 21, 1984

[51] Int. Cl.[3] ..... D06F 75/16

[52] U.S. Cl. ..... 38/77.83; 219/254

[58] Field of Search ..... 68/222; 219/256, 254; 38/77.7, 77.8, 77.83, 77.82

[56] References Cited

U.S. PATENT DOCUMENTS

| | | | |
|---|---|---|---|
| Re. 28,418 | 5/1975 | Osrow | 38/69 |
| 2,596,684 | 5/1952 | Hedenkamp | 38/77.7 |
| 2,601,059 | 6/1952 | Rotheraine | 219/21 |
| 2,664,653 | 1/1954 | Voskresenski | 38/77 |
| 2,701,424 | 2/1955 | Schreyer | 38/77 |
| 2,750,694 | 6/1956 | Spencer | 38/77 |
| 2,777,225 | 1/1957 | Cone | 38/77 |
| 2,786,287 | 3/1957 | Swann | 38/77 |
| 3,003,266 | 10/1961 | Horwitt et al. | 38/77 |
| 3,061,959 | 11/1962 | Blumenfeld | 38/77 |
| 3,646,317 | 2/1972 | Osrow | 219/271 |
| 3,675,449 | 7/1972 | Bluestein | 68/222 |
| 3,695,066 | 10/1972 | Doyel | 68/222 |
| 3,733,723 | 5/1973 | Takakuwa et al. | 38/69 |
| 3,742,629 | 7/1973 | Plasko | 38/69 |
| 3,755,649 | 8/1973 | Osrow | 219/245 |
| 3,811,208 | 5/1974 | Vieceli et al. | 38/77 |
| 3,969,607 | 7/1976 | Osrow | 219/272 |
| 3,997,759 | 12/1976 | Osrow et al. | 219/272 |
| 4,190,762 | 2/1980 | Santiago et al. | 219/245 |
| 4,196,340 | 4/1980 | Evans et al. | 219/245 |
| 4,206,340 | 6/1980 | Osrow | 219/272 |
| 4,366,367 | 12/1982 | Mazzucco | 219/272 |

FOREIGN PATENT DOCUMENTS

| | | | |
|---|---|---|---|
| 2554508 | 6/1977 | Fed. Rep. of Germany | 38/77.8 |

*Primary Examiner*—Werner H. Schroeder
*Assistant Examiner*—Andrew M. Falik
*Attorney, Agent, or Firm*—Cooper, Dunham, Clark, Griffin & Moran

[57] ABSTRACT

A device which can be used either for steaming alone or for pressing as well. It generates steam by passing electrical current between electrodes immersed in electrolyte (e.g., lightly salted water). A positive safety interlock both (i) prevents the electrical cord plug from making electrical contact with the device except in the sealed and locked position of the stopper for the hole through which the device is filled with electrolyte and (ii) prevents the stopper from being moved away from its sealed and locked position while the cord plug is in place. Additional important features include a handle which provides good thermal insulation and pivots between a working position away from the device and a storage position in which it is pressed against the device and releasably locks in each position, baffles and a box to keep droplets of hot water from being carried by the steam exiting the device (in any orientation thereof and even when it is vigorously shaken), a cup for measuring the suitable quantity of electrolyte which has an integral salt measure and additionally serves as a stand for using the device as an upright steamer, provisions against overfilling the device with electrolyte and provisions for locking the cup to the device for storage.

6 Claims, 13 Drawing Figures

PORTABLE, HAND-HELD STEAMING OR PRESSING DEVICE

BACKGROUND AND SUMMARY OF THE INVENTION

The invention is in the field of hand-held steaming/-pressing devices which are light and easily portable. Numerous devices of this general type have been proposed in the past. For example, Doyel U.S. Pat. No. 3,695,066 (by the same inventor) shows a portable, hand-held steamer which works on the same principle of passing electrical current between electrodes immersed in electrolyte such as a water soluton of table salt and which has a steam conduit inlet at the approximate geometric center of the housing interior so as to keep water from entering it when the device is tipped or inverted. The device also has a handle which slides between a working position and a storage position. Other steamers are proposed in U.S. Pat. Nos. 3,646,317; 3,733,723 and 3,997,759. A steamer with an attachment in the form of an ironing sole is proposed in U.S. Pat. No. Re. 28,418, and steamers which have sole plates at their bottoms are proposed in U.S. Pat. Nos. 3,755,649; 3,811,208; 3,969,607; 4,190,762; 4,196,340; and 4,206,340. Other U.S. Pat. Nos. of general interest include 2,601,059; 2,664,653; 2,701,424; 2,750,694; 2,777,225; 2,786,287; 3,003,266; 3,061,959 and 3,742,629. The following U.S. patent classifications may be of interest: class 38, subclasses 69, 77.4 and 77.5, class 68, subclass 222 and class 219, subclass 271.

The desirable characteristics of steaming/pressing devices of this general type are believed to include lightweight, compact size, reliability, ease of operation, safety, low manufacturing cost and ease of assembly (and hence low price) and various other conveniences to the user. While the prior proposals known to applicant have sought to meet at least some of these design goals, it is believed that a substantial need still remains for meeting all of them, and perhaps additional ones as well, and this invention is directed to that end.

In an examplary and nonlimiting embodiment, a device using features of the invention comprises a hollow, sealed housing having a front and a back end and a sole plate which has a steam outlet. A filling hole is positioned so as to allow only a selected quantity of liquid electrolyte to be poured in before overflowing, as a safety feature to help ensure that the device would not draw excessive current or generate excessive amount of steam. A filling hole stopper is manually movable between a locked position, in which it engages and seals the filling hole, and a filling position in which it can be moved away from the filling hole to allow pouring electrolyte in the housing. The interaction between the stopper, the filling hole and the rest of the housing is such that the electrical cord used to supply current to the device cannot be plugged into the device unless the stopper is in its locked position sealing the filling hole. Moreover, the relative arrangement is such that once the cord is plugged into the device, the stopper cannot be moved away from its locked and sealed position. This two-sided safety feature is relied on to prevent direct electrical contact between the electrolyte, the current source and the user, to thereby avoid possible electrical shock, and also helps ensure that in operation steam would exit the device only through the steam hole designed for the purpose. It is believed that while a partial interlock between a filling hole and a cord may have been proposed in some of the known prior documents (e.g., U.S. Pat. Nos. 4,366,367; 3,969,607 and 3,997,759) no full interlock of the type taught in this disclosure has been described or suggested therein. A steam conduit has its downstream end connected to the steam outlet in the sole plate and has its upstream end open within a battled steam box which has steam inlet holes positioned and oriented to minimize the chance of water droplets being carried by the steam into the steam conduit and out the steam outlet. Moreover, the steam inlet holes are at the approximate geometric volume center of the housing, so no liquid would flow in the steam box regardless of how the device is oriented. While some of the prior documents propose placing the steam conduit inlet at the approximate geometric center (U.S. Pat. Nos. 3,695,066 and 4,206,340), they do not teach or suggest the extensive provisions described in this specification of minimizing the possibility of water droplets being carried by the steam coming out of the steam outlet in the sole plate. A handle is pivotally secured at its front end to the housing top and moves between a working position up from the housing, in which it can be easily grasped without bringing the user's hand too close to hot portions of the device, and a storage position down against the housing, to minimize the housing size and facilitate convenient storage. The handle is locked in either of its two positions by a spring biased lock, which can be manually released to move the handle to its other position. The device includes a measuring cup which has an integral salt measure and is shaped and dimensioned to envelope the back end of the housing either for storage or for use as a stand so that the device can operate as an upright steamer rather than as a pressing iron. In the alternative, the device can be used as a hand-held upright steamer without using the cup as a stand. The cup and the handle interact to lock the cup to the housing when the cup is in place and the handle is brought down to and locked in its storage position, to thereby store the device, with the cup, as a compact unit. The cup bottom is sufficiently flat and is arranged relative to the center of gravity of the device to facilitate its use as a convenient stand. Moreover, the handle is shaped and dimensioned to serve as an extra leg for when the device is used as an upright steamer supported on a flat surface. While a handle telescoping between a storage and a working position is shown in U.S. Pat. No. 3,695,066, it is believed that no pivoting handle interacting with a measuring cup in the manner described in this specification is taught or suggested in the prior art. The electrodes which pass current through electrolyte in the housing are positioned and dimensioned to be immersed in electrolyte and thereby generate steam when the device is either resting on its sole plate or is used as an upright steamer but not when it rests on its side or points down or is upside down, thereby affording a convenient way for interrupting the flow of current and steam generation without the use of an electrical switch. Extensive provisions are made to keep electrolyte or steam from exiting through the openings for supplying electric current to the electrodes, and to minimize the effects of any such escape, should it occur. When the device runs out of electrolyte, it shuts itself off. These and other features of the invention are described in greater detail below.

DETAILED DESCRIPTION

Figures 1, 2, 3, 4, 5, 6:
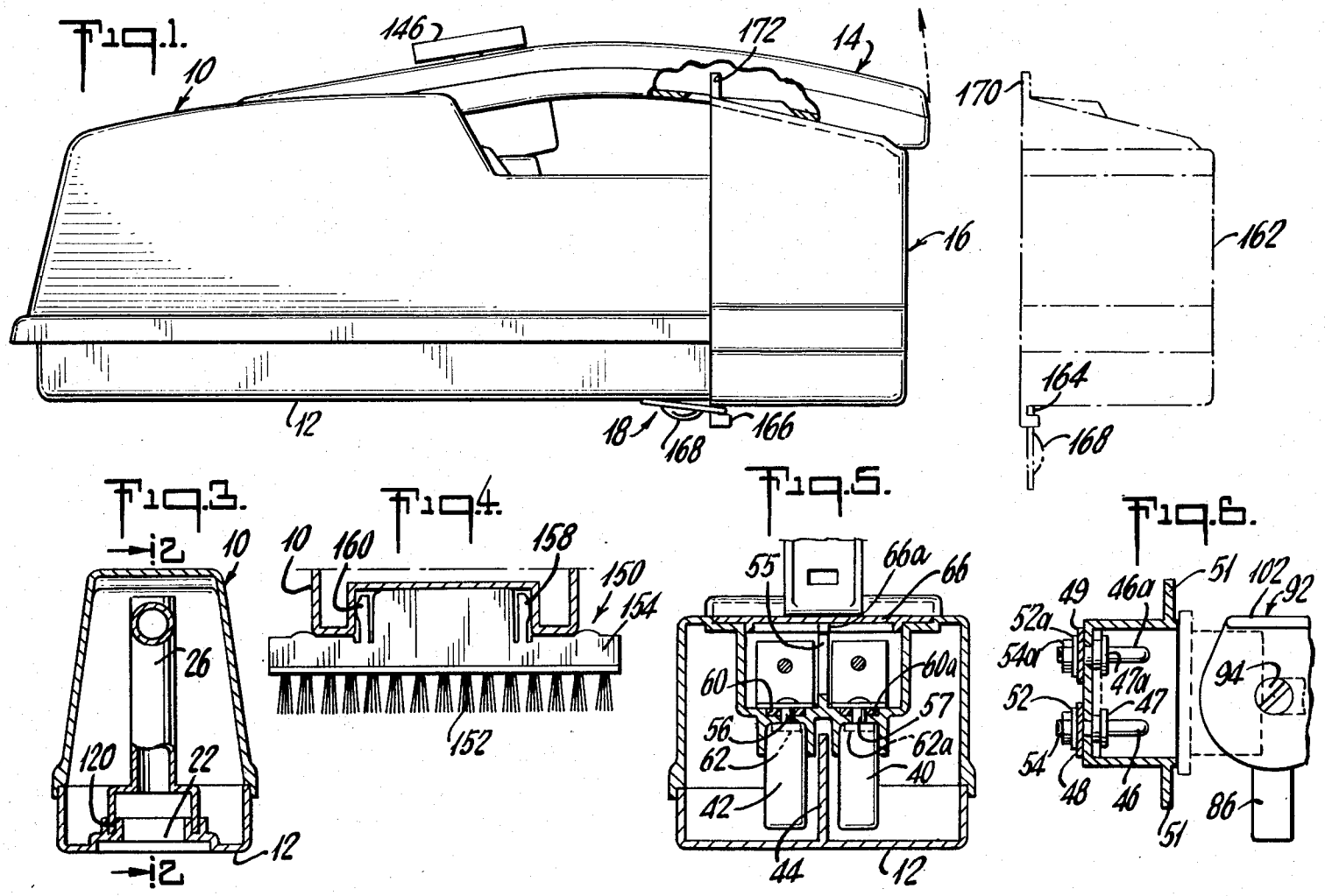
FIG. 1 is a side elevational view of a device embodying the invention when in its storage position and shows in dash and dot lines a measureing cup with a pivoted, integral salt measure.
FIG. 2 is a sectional view taken along line 2—2 of FIG. 3.
FIG. 3 is a sectional view taken along line 3—3 of FIG. 2.
FIG. 4 is a partial sectional view taken along line 4—4 of FIG. 2.
FIG. 5 is a partial sectional view taken along line 5—5 of FIG. 2.
FIG. 6 is a partial view partly in plan and partly in section of a stopper for sealing a filling hole and of electrical contacts.
Figure 2:
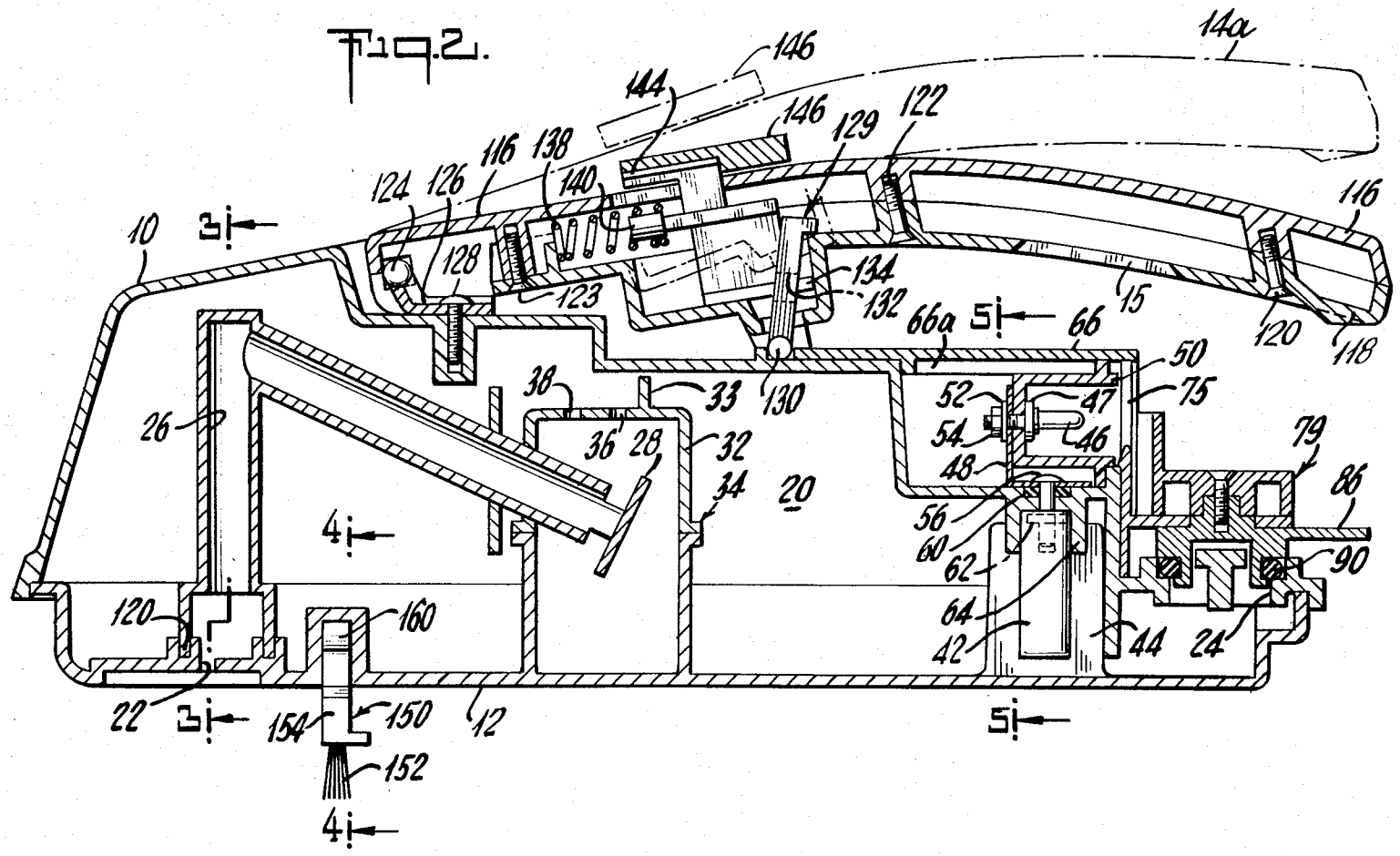

Referring to FIGS. 1-3, the device comprises a housing which is generally indicated at 10 and has a sole plate 12, a handle 14 and a measuring cup 16 with an integral salt measure 18. Handle 14 is shown in its storage position in solid lines in FIGS. 1 and 2 and in its working position in dash and dot lines in FIG. 2. Similarly measuring cup 16 is shown in FIG. 1 in solid lines in its storage position and is shown separately, in dash and dot lines, with salt measure 18 pivoted to its working position. Housing 10 is a clam shell structure made up of a top and a bottom part affixed to each other, e.g. bonded through the use of adhesives or the like, to form an interior volume 20 which has fluid flow communication with the ambient only through a steam outlet hole 22 in its sole plate 12 and through a filling hole 24 at the back end of housing 10. Filling hole 24 is positioned such that when sole plate 12 is on a level surface, at most the appropriate amount of liquid electrolyte can be poured in before overflowing hole 24. Steam outlet 22 is at the downstream end of steam conduit 26 whose open upstream end is guarded by a baffle 28 and is within a steam box made up of bottom piece 30 and top piece 32 joined to each other at a seam 34, e.g., by bonding with adhesives or the like. Top piece 32 has a baffle 33 extending up from the back part of its top surface and two rows of steam inlet holes in the front part of its top surface. Only steam inlet holes 36 and 38 are visible in FIG. 2, but in fact two parallel rows of five steam inlet holes each are used in an exemplary embodiment, with each row extending in a direction perpendicular to the plane of FIG. 2 and with the holes uniformly spaced along the dimension of box 32 in the direction perpendicular to the drawing plane. Baffle 33 extends along the entire top dimension of box 32 in the direction perpendicular to the plane of FIG. 2. The box made up of pieces 30 and 32 is hollow, such that steam generated in the interior volume enclosed by housing 10 and sole plate 12 enters the box through the two rows of steam inlet holes 36 and 38, then enters steam conduit 26 through the opening between baffle 28 and the walls of the steam conduit, then proceeds downstream through steam conduit 26 and exits through steam outlet 22 in sole plate 12. Baffle 33 helps keep droplets from reaching holes 36 and 38 even when the device is upright and the electrolyte is boiling vigorously, and the arrangement of holes 36 and 38 and their small size (e.g., less than $\frac{1}{8}$ inch diameter) as compared to a single steam inlet hole having an area comparable to the combined areas of holes 36 and 38 also help keep droplets from being carried by the steam exiting through steam outlet 22.

To generate steam, a pair of generally round electrodes 40 and 42 (made of a material such as carbon or the like) extend into interior volume 20 and are separated by a baffle 44 which extends up from sole plate 12 and keeps them from making electrical contact with each other and also from passing current to each other via ion exchange along direct lines between them. Referring to FIGS. 2, 5 and 6 electrode 42 makes electrical contact with a male connector 46 via an L-shaped metal bracket 48. Connector 46 is inside a receptacle box 50 which is open at its back end to receive the female plug of an electric cord (not shown) whose other (male) end can be plugged into a household power outlet (e.g. a 115-volt a-c outlet). Connector 46 is secured to box 50 and plate 48 by an integral extension which passes through a temperature-resistant grommet 47 made of silicon or the like and then through suitable holes in box 50 and plate 48 and is fastened by means of a lock washer 52 and threaded nut 54. Electrode 42 is secured by means of a screw whose head 56 is above bracket 48 and whose shank 58 passes through a heat resistant washer 60 similarly made of silicon or the like, then through a suitable opening in housing 10, then through another, similar heat resistant washer 62 and then threads into electrode 42. For mechanical stability and other benefits, the top end of electrode 42 is received within a sleeve 64 which is integral with housing 10 and extends down into interior volume 20 and can, if desired, be bonded to electrode 42 with a material such as silicon. Electrode 40 is symmetrically secured and electrically connected in the corresponding manner, and the description thereof will not be repeated. For user safety, the mounting of electrodes 40 and 42, particularly with the use of heat resistant washers such as 60 and 62, is such that both steam and water are kept from escaping interior volume 20 through the holes in housing 10 through which the mounting screws (e.g. 58) for the electrodes pass.

Also for user safety, receptacle box 50 is shaped and dimensioned such that bracket 48 (and the corresponding bracket 49 for electrode 40) are completely mechanically shielded from exposure to the ambient, to prevent electrical shock. A plastic plate 64 extends forwardly from the front end of receptacle 50 to separate the electrical supply lines of electrodes 40 and 42 from each other and help prevent shorts, even if a small amount of steam or electrolyte should escape through one or both of the housing holes for the mounting screws of electrodes 40 and 42, and a plastic top plate 66 fully closes off the top of receptacle 50 to fully enclose the electrically conductive parts and further reduce exposure of current carrying portions to the ambient and thereby reduce the possibility of electric shock. Plate 66 is secured to housing 10 by suitable fasteners, such as screws (not shown) passing through holes 67 therein (see FIG. 7), or by bonding with suitable adhesives, or by ultrasound welding. Nore that as a further safety measure plate 66 has a downwardly extending ridge **66*a* which bears against the top of and is co-extensive with a baffle 55 which extends from housing 10 and completely separates the chamber enclosing brackets 48 and 49** into two subchambers, one for the electrical path to each respective electrode.

Referring to FIGS. 2, 6 and 8–12, the filling hole stopper which is generally indicated at 79 and seals hole 24 and provides a safety interlock with the electrical connectors in receptacle 50 comprises a carrier 68 which has a horizontal ledge 70 and a vertical plate 72 and slides vertically within a channel 75 integrally formed in housing 10. When stopper 79 is in its locked position, in which it seals filling hole 24, it is as shown in FIG. 2; when stopper 79 is in its unlocked position (to be discussed in more detail below) it can be lifted up by sliding vertical plate 72 up in channel 75, and the barbed tip 74 of an upwardly extending projection 76 can be moved up over the top surface of an indentation 78 in top plate 66, to retain stopper 79 in its up position and allow for convenient pouring of electrolyte into interior volume 20. Note that when plate 72 is in up position, it blocks the opening of receptacle 50, to serve as a splash guard keeping connectors 46 and **46*a* and the receptacle interior from getting wet with splashed electrolyte. The size of plate 72 is such that it can completely cover the receptacle opening. Ledge 70 has a central opening 80 which receives rotationally the upwardly extending sleeve 82 of a stopper lock which is generally indicated at 84 and includes a rearwardly extending handle 86 and a body including a seat 88 for a heat resistant silicon rubber O-ring 90. A retainer plug 91 has a flange 91*a*, to help form a channel for O-ring 90, and a sleeve 91*b* which fits into the hollow opening 84*a* of lock 84, aligned by means of slot 91*c* and key 84*b*, and is bonded in place, as with an adhesive or the like. A cap generally indicated at 92 comprises a skirted enclosure which fits over sleeve 82 and is secured thereto by means of a threaded screw 94 (or by bonding or sonic welding) and has on its underside a sleeve 96 (FIG. 9) which receives the top portion of sleeve 82 and has a key slot 98 which receives and locks with a key 100 extending from sleeve 82. For a positive and two-sided safety interlock with the electrical cord plug (not shown), cap 92 has an integral vertical plate 102 which, as described in more detail below, helps block access to receptacle 50 at all times except when stopper 79 locks and seals filling hole 24**.

Figures 7, 8, 9, 10, 11, 12, 13:
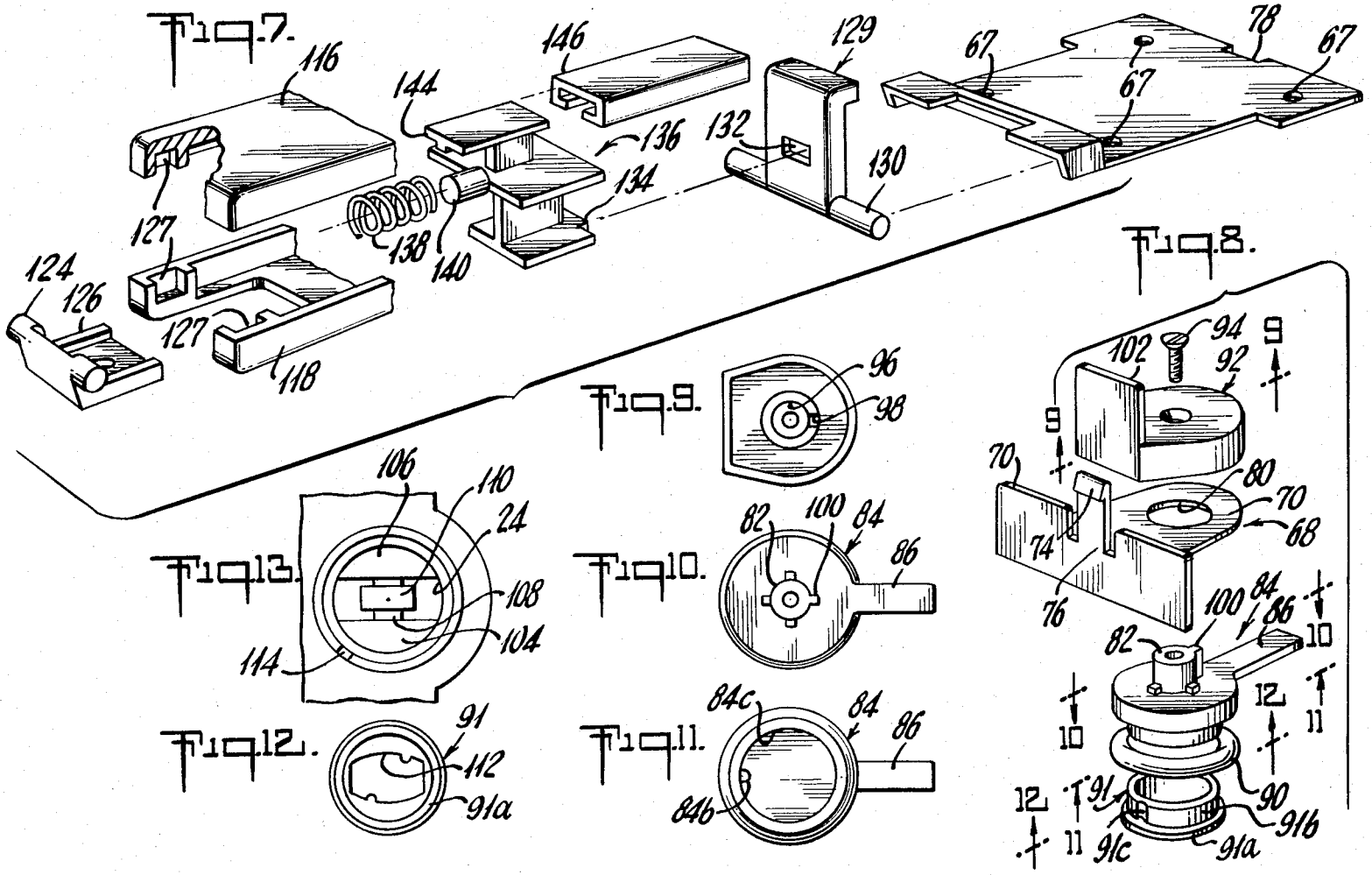
FIG. 7 is an exploded perspective view of a portion of the device involved in locking a handle in its working and storage positions.
FIG. 8 is an exploded perspective view the stopper used to seal the filling hole.
FIGS. 9-12 are plan views of stopper parts.
FIG. 13 is a top plan view of the filling hole.

As best seen in FIGS. 2 and 13, filling hole 24 comprises two symmetrical ledges 104 and 106 connected by a bridge 108 from which a T-shaped post 110 extends upwardly. As best seen in FIG. 12, the bottom end of locking piece 84 comprises a hollow chamber having at its bottom side an opening 112 which can receive T-shaped post 110 when lowered onto post 110 with handle 86 pointing rearwardly, but has a bottom plate 114 which engages the underside of the top of post 110 when pressed down and twisted clockwise when viewed from the top of housing 10, until handle 86 reaches and is stopped by a post 114 vertically extending from housing 10 (FIG. 13).

As best seen in FIGS. 2 and 7, handle 14 has a clam shell construction made up of an upper part 116 and a lower part 118 secured to each other by screws 120 and 122. Handle 14 pivots about an axle 124 which is at the top and front end of a bracket 126 secured to housing 10 by screw 128. Axle 124 is rotationally received within journal openings 127 formed in the forward end of parts 116 and 118 of handle 14. A handle lock plate generally indicated at 129 has at its lower end an axle 130 received for rotation in a journal opening formed between the forward end of plate 66 and the top of housing 10, and has a central opening 132 shaped, dimensioned and positioned to receive, when handle 14 is in its storage position, a rearwardly extending projection 134 of a handle interlock piece generally indicated at 136. Unit 136 is rearwardly biased by means of a compression spring 138 carried on a rearwardly extending post 140 and retained against a post 142 extending upwardly from lower handle half 118. When a handle 14 is in its working position **14*a* up from housing 10, projection 134 fits over the top end of lock piece 128. A button projection 144 of piece 136 extends upwardly through an opening in top half 116 of handle 14, and channel shaped thumb botton 146 slides thereon and frictionally locks thereto so that, when manually pushed forwardly, it moves piece 136 forwardly and compresses spring 138 against its bias to unlock handle 14 from either of its working and storage positions. In its working position, the back end of handle 14 is sufficiently above housing 10 and plate 66, which can get hot in use, so that a user's hand can easily grasp handle 14 while remaining comfortably far from hot surfaces. As handle 14 is made of hollow plastic material, and has numerous springs providing ventillation (including at 15**) it has good thermal insulation properties, and remains cool in use.

As best seen in FIGS. 2 and 4, a brush assembly generally indicated at 150 has bristles 152 and a body 154 and fits within a mating opening 156 in sole plate 12. The fit within opening 156 is frictional so that the brush assembly can be easily inserted by hand to be retained on the device but just as easily can be pulled out by hand when not needed. As best seen in FIG. 4, brush assembly 154 has resilient fingers 158 and 160 which are bent inwardly as the brush assembly is pushed up into opening 156 so as to bear frictionally against the sides of the opening and retain the brush assembly in place.

As best seen in FIG. 1, measuring cup 16 comprises a hollow vessel with a flat bottom 162 and an integral salt measure 18 pivoting relative to cup 16 about an axle 164 snap-fitted into suitable journal opening 166. Salt measure 18 pivots betweena storage position shown in FIG. 1 in solid lines and a measuring position shown in dash and dot lines in the same figure, and has a bowl 168 which can contain the amount of salt suitable for the amount of water contained in cup 16.

The device can be stored in the position illustrated in solid lines in FIG. 1. To use it as a steaming and/or pressing device, thumb button 146 is pushed forward, against the bias of spring 138, and handle 14 is pivoted up from its storage to its working position **14*a*, until projection 134 (FIG. 7) comes over the top of lock piece 129. When thumb button 146 is released,, the bias of spring 138 pushes projection 134 over the top of piece 129 to thereby lock handle 14 in its working position. Note that lifting handle 14 up from its storage position releases its interlock with measuring cup 16 (i.e. lifts handle opening 178 up until after it clears upwardly extending spout projection 170 of measuring cup 16), so that measuring cup 16 can now be removed from the device. If the device is empty or contains an insufficient amount of electrolyte, measuring cup 16 is filled with water mixed with the amount of table salt which can fit in the bowl 168 of salt measure 18. Assuming that at this time the cord plug is not connected to the metal connectors in receptacle 50, and that stopper 79 is in its locked and sealed position, handle 86 is moved counterclockwise when viewed from the top of the device, to move stopper 79 from its locked and sealed to its unlocked position in which handle 86 points straight back. In that position stopper 79 can be lifted up, with plate 102 sliding within channels 75 until barbed projection 74 snaps over the top of plate 66, to keep stopper 79 up and away from filling hole 24 but to keep plate 72 over receptacle 50, serving as its splash guard. With the sole plate horizontal or nearly horizontal, electrolyte is poured in through filling hole 24. As earlier noted, the position of filling hole 24 is such that if an attempt is made to pour in more than the maximum permissible amount of electrolyte, it would overflow. Once sufficient amount of electrolyte has been poured in, stopper 79 is pushed down (if necessary barbed projection 74 is first pushed rearwardly to release it from top plate 66), until O-ring 90 is down against filling hole 24. Handle 86 is then rotated clockwise, to lock stopper 79 onto post 110 and compress O-ring 90 (to thereby seal the interior volume), until handle 86 comes to bear against post 114. The relative dimensions are such that this compression deforms ring 90 to press its top, bottom and outer side surfaces against the adjoining plastic surfaces. It is only in this sealed and locked position that guard plate 102 (which rotates with handle 86) clears the opening in receptacle 50 sufficiently to allow the plug of an electric cord to be inserted therein and make electrical contact with the connectors for electrodes 40 and 42. With one end of the electrical cord in place in receptacle 50 and in suitable electrical contact with the device, and with the outer end of the cord plugged in at a power outlet, electrodes 40 and 42 are supplied with current and, provided they are immersed in electrolyte, current flows through the electrolyte to heat the electrolyte and generate steam. This steam enters box 32 through steam inlet holes 36 and 38 and then enters steam conduit 26 and exits sole plate 12 through steam outlet 22. The device can be used as a steam alone, with or without brush assembly 150 by holding it upright, with the front end pointing upwardly, and moving it as desired relative to the object(s) being steamed. As an alternative measuring cup 16 can be used as a stand—placing cup 16 on a flat surface, with its bottom 162 thereon, and with the back end of the device in it. In that position the back end of handle 14 serves as an extra leg to stabilize the device. As another alternative, the device can be used as a pressing iron (without brush assembly 150 and cup 16**).

The relative disposition of operative parts is such that when the device is laid on its side (or is upside down or with the front end pointing downwardly) electrodes 40 and 42 are no longer immersed in electrolyte (provided no more than the appropriate amount of electrolyte has been poured into the device). Thus, there is no need for an electrical switch, as current flow can be cut off simply by laying the device on its side. For storage, the procedure is reversed: the electrical cord is unplugged from the device (note that while the cord is plugged into the device, guard plate 102 just clears it, and an attempt to rotate handle 86 away from the sealed and locked position of stopper 79 is foiled by the contact between guard plate 102 and the female plug of the electrical cord), cup 16 is put on the back end of the device and thumb button 146 is pushed forwardly and handle 14 pushed downwarly to bring it to its storage position, in which projection 134 is allowed to be driven by spring 138 into hole 132 to lock the handle in its storage position and concurrently lock cup 16 in its own storage position.

An important feature of the embodiment of the invention described here is that the shape of the interior volume for the electrolyte and the location and nature of the electrodes and interior parts maximize the area of contact of hot liquid and steam with the sole plate when the device is in the horizontal, ironing position, to thereby efficiently heat the sole plate for effective ironing. Moreover, when the device is in the horizontal, ironing position, the electrodes are immersed in electrolyte to a considerably lesser degree than in the vertical, steaming position, and as a result a relatively lesser amount of steam is generated in the horizontal, ironing position, as is desirable for effective ironing. Conversely, the same shape of the interior volume and the same location and nature of the electrodes and other interior parts cause a significantly greater amount of steam to be generated, as the electrodes are immersed in electrolyte to a much greater degree than in the horizontal position of the sole plate, with the result that a significantly greater amount of steam blows out of the steam outlet in the sole plate when it is upright, as is desirable for effective steaming. This difference in the rate of steam generation as between the horizontal and upright positions of the sole plate has an added benefit: a load of electrolyte lasts much longer when the sole plate is horizontal than when it is upright, which matches typical usage in which the device is kept on for a longer period of time for horizontal ironing than for upright steaming.

The exemplary embodiment described above is particularly convenient to manufacture and assemble in a manner which minimizes its cost to the consumer and enhances reliability and ease of use. Housing 10 is made up of two integrally molded plastic material components which are affixed to each other (as by bonding with adhesives or the like) after steam conduit 26 and steam box 34 are assembled onto the lower part of housing 10 in the indicated manner and after electrodes 40 and 42 and the brackets (e.g. 48) are mounted as illustrated in FIG. 2. Conduit 26 can be assembled from molded halves (a half is visible in FIG. 2) bonded with adhesives or sonic welding, and the resulting structure can be similarly bonded to a channel section receptacle 12*a* molded integrally with sole plate 12. The upsteam end is then bonded to lower part 30 of the steam box, and top part 32 is then bonded to bottom part 30 at seam 34 and to the upstream end of conduit 26. Connectors 46 and 46*a* and brackets 48 and 49 and screws 56 and 57 (and grommets 47, 47*a*, lock washers 52, 52*a*, nuts 54, 54*a* and washers 60, 60*a*) are then put together as a subassembly. To facilitate this, connectors 46, 46*a* can have hex backs fitting in matching hex openings in receptacle 50, and screws 56, 57 can have (under their heads) hex sections fitting in matching hex openings in brackets 48, 49. With screws 56, 57 so kept from rotating relative to brackets 48, 49, washers 62, 62*a* are positioned over screws 56, 57, and electrodes 40, 42 are threaded on screws 56, 57 from below (the electrodes can have flat surfaces near their bottoms to make it easier to be grasped by a suitable tool). The housing parts can now be put together and bonded to each other. Handle 14 can be put together as a subassembly, by loading spring 138 onto projection 140, positioning axle 124 of bracket 126 in place and unit 136 in place between the handle portions 116 and 118, securing the two portions to each other by screws 120, 122 and 123 (or by bonding or sonic welding) such that portion 144 protrudes through top portion 116 and sliding thumb button 146 thereon. Note that receptacle 50 has two positioning plates 51 which fit into corresponding channels (not shown) in housing 10, and can slide down those channels to the position illustrated in FIG. 2. Stopper 79 can be put together as a subassembly, in the manner indicated by the exploded view of FIG. 8, and can be slid down channels 75 to the position illustrated in FIG. 2. The handle assembly can then be secured to the housing, e.g., by means of screw 128 through bracket 126, axle 130 can be put in place on housing 10 and plate 66 secured over it by means of screws through holes 67 therein, and the handle can be locked in place by pivoting it down so that the upper part of unit 128 enters the interior of handle 14. Note the slanted cut at the top end 131 of lock plate 130, which allows it to enter handle 14 simply by pressing the handle on it. The device is now ready to use or to store as discussed above.

Nearly all of the parts are made of molded thermoplastic material, such as GE Noryl SE1 or the like, and can be assembled nearly completely by hand, with only simple hand tools. Of course, if sonic welding is used, suitable equipment is employed .

I claim:

1. A portable, hand-held steaming/pressing device comprising:

a hollow, sealed housing having a front and a back end and a sole plate at its bottom, said plate having a steam outlet therein, and a filling hole positioned a selected distance above the sole plate to allow only a selected quantity of liquid electrolyte to be poured into the housing before overflowing when the sole plate is on a horizontal surface and a filling hole stopper manually movable between a locked position in which it engages and seals the filling hole, and a filling position, in which it can be moved away from the filling hole to allow pouring electrolyte onto the housing;

a pair of electrodes positioned inside the housing to be immersed in electrolyte when the housing is resting on the sole plate on a horizontal or nearly horizontal surface or the front end of the housing points upwardly but not when up to said selected quantity of electrolyte is in the housing and the housing is upside down or on its side or its front end points downwardly, and a pair of electrical connector elements respectively connected electrically to the electrodes and extending outwardly of the sealed housing for connection with the plug of an electrical cord connectible to an electrical power outlet; and safety interlock means for both (i) preventing the filling hole stopper from being moved from its locked to its filling position while the cord plug makes electrical contact with said connector elements and (ii) preventing the plug from being moved into electrical contact with said connector elements while the stopper is in its filling position;

said electrodes, when immersed in electrolyte and connected electrically to a power outlet, passing electrical current through the electrolyte and thereby heating it to generate steam, and said steam exiting the housing through said seam outlet in the sole plate.

2. A device as in claim 1 including means for securing the filling hole stopper to the housing to prevent removal thereof from the housing, wherein the safety interlock means comprise a plug guard affixed to the filling hole stopper to move therewith and shield the connector elements and prevent them from making contact with the plug of an electric cord when the stopper is at any position other than its locked position.

3. A device as in claim 2 comprising an elongated handle pivotally secured at its front end to the top of the housing and movable between a working position up from the housing and a storage position down against the housing, spring bias means locking the handle in place when it is moved into either of its working and storage positions, and manually operable handle release means movable against the bias of the means locking the handle to release the handle from either of its locked positions so that it can be manually pivoted to its other locked position.

4. A device as in claim 3 including a measuring cup having an integral salt measure and shaped and dimensioned to envelope the back end of the housing, said cup and said handle having interlock means to lock the cup to the housing when the cup is in place over the back end of the housing and the handle is brought down to and locked in its storage position, to thereby store the device and the cup as a compact unit, and said cup having a bottom which is sufficiently flat and is arranged relative to the center of gravity of the device to cause the cup to serve as a stand into which the device can be inserted with its front end pointing upwardly and with the steam outlet clearing the cup.

5. A device as in claim 4 in which the back end of the handle terminates at a plane matched to that of the bottom of the cup when the device is inserted in the cup to cause said back end of the handle to serve as an additional support for the device when the cup is used as a stand therefor.

6. A device as in claim 5 including a steam conduit positioned inside the housing and having a downstream end connected to the steam outlet in the sole plate, and a hollow steam buffer box extending upwardly from the sole plate into the interior of the housing and connected to the upstream end of the steam conduit and having steam inlet openings in the top thereof which are above the level of the filling hole when the sole plate is on a horizontal surface and are at the approximate volume center of the interior of the housing to keep liquid from entering the steam inlet holes in any orientation of the housing when up to said selected amount of liquid is in the housing and to keep liquid droplets from being carried by the steam out of the steam outlet in the sole plate.

* * * * *